US009670050B1

(12) United States Patent
Casher et al.

(10) Patent No.: US 9,670,050 B1
(45) Date of Patent: Jun. 6, 2017

(54) THERMOELECTRIC WINE BAG COOLER/DISPENSER

(71) Applicants: Calvin Casher, Missouri City, TX (US); Labata Casher, Missouri City, TX (US)

(72) Inventors: Calvin Casher, Missouri City, TX (US); Labata Casher, Missouri City, TX (US)

( * ) Notice: Subject to any disclaimer, the term of this patent is extended or adjusted under 35 U.S.C. 154(b) by 450 days.

(21) Appl. No.: 14/473,902

(22) Filed: Aug. 29, 2014

Related U.S. Application Data

(60) Division of application No. 12/460,100, filed on Jul. 12, 2009, now Pat. No. 8,820,094, and a continuation-in-part of application No. 11/983,455, filed on Nov. 8, 2007, now abandoned.

(51) Int. Cl.
*F25B 21/02* (2006.01)
*B67D 3/00* (2006.01)

(52) U.S. Cl.
CPC ..... *B67D 3/0009* (2013.01); *B67D 3/008* (2013.01); *B67D 3/0067* (2013.01); *F25B 21/02* (2013.01)

(58) Field of Classification Search
CPC ..... F25B 21/02; B67D 1/0859; B67D 3/0009; B65D 83/0077
USPC ..... 62/3.64, 3.2, 3.6
See application file for complete search history.

(56) References Cited

U.S. PATENT DOCUMENTS 4,913,713 A * 4/1990 Bender ..... B67D 1/06 222/146.6

* cited by examiner

*Primary Examiner* — John F Pettitt
(74) *Attorney, Agent, or Firm* — Kenneth A. Roddy

(57) ABSTRACT

A thermoelectric wine pouch cooler/dispenser apparatus powered by household current has a thermally insulated cabinet that sits on a countertop or other flat surface and has a thermoelectric cooling system. The cabinet has at least one thermally insulated compartment that receives a removable bag support housing containing a collapsible flexible wine-filled bag from a "bag-in-box" wine container and its dispensing valve. The bag support housing includes a spring biased plate to facilitate emptying of the contents of the bag. The temperature of each compartment is individually controlled by a digital temperature controller and a thermoelectric cooling assembly which includes a fan and a cold plate engaged on a thermally conductive heat transfer block at the top of each compartment which engages the bag support housing.

8 Claims, 6 Drawing Sheets

THERMOELECTRIC WINE BAG COOLER/DISPENSER

CROSS REFERENCE TO RELATED APPLICATION

This application is a Divisional of and claims priority of U.S. patent application Ser. No. 12/460,100, filed on Jul. 12, 2009, now pending, which is a Continuation-In-Part of and claims priority of U.S. patent application Ser. No. 11/510,179, filed on Jan. 22, 2007, now abandoned.

BACKGROUND OF THE INVENTION

1. Field of the Invention

This invention relates generally to refrigerated beverage dispensing apparatus, and, more particularly to a thermoelectric wine bag cooler/dispenser powered by household current having a cabinet that sits on a countertop or other flat surface and which includes a thermoelectric cooling system and at least one compartment that receives a removable bag support housing containing a collapsible flexible wine-filled bag from a "bag-in-box" wine container and its dispensing valve and the temperature of each compartment is individually controlled.

2. Background Art

Many liquids are susceptible to deterioration upon exposure to oxygen. Among these, wines are particularly vulnerable to rapid oxidation due their basic chemistry. To prevent this condition, most commercial wineries fill the container under vacuum or by sparging with an inert gas to exclude the oxygen. This precaution is further complicated by the use of closures, i.e. natural cork, which are susceptible to oxygen intrusion or other containments such as trichloroanisole (TCA). Even with these precautions, when the container is subsequently opened, oxygen intrusion immediately occurs and begins the process of oxidation and spoilage and the remaining product rapidly degrades/spoils.

"Bag-in-box" wines, wherein the wine is contained in a collapsible a vacuum-sealed plastic bag inside a cardboard or paperboard box and dispensed through a valve at the bottom of the container, and typically closed with a plastic cap, addresses both problems (oxygen intrusion and closure), and are becoming increasingly popular with consumers. "Bag-in-box" wine is not subject to cork taint or spoilage, even after the wine has been opened. Once open, a box preserves wine for about four weeks compared with only a day or two for a bottle after it has been uncorked. "Bag-in-box" wines also have environmental and economic benefits because they require less energy to produce and transport, and are fully recyclable, yielding less packaging waste.

Most wines should also be kept at a constant temperature in the 40° to 60° range and are often stored in a refrigerator. However, keeping wine in a refrigerator can have its drawbacks, since the wine takes up a considerable amount of space and it is necessary to open and close the refrigerator door regularly, which decreases the interior temperature of the refrigerator.

There are several patents directed toward various apparatus for cooling and dispensing various beverages such as wine, some of which accommodate "bag-in-box" containers.

Crossley et al, U.S. Pat. No. 7,464,567 discloses a non-electric apparatus for cooling and dispensing wine from a wine-filled bag of a prepackaged "bag-in-box" wine box, generally comprising an insulated parallelepiped box with molded handles, an upper front panel and a lower front panel with semi-circular notches forming a circle into which the wine tap for such wine-filled may be locked into place for dispensing wine, and a drip reservoir. This apparatus does not utilize thermoelectric cooling. Instead, one embodiment employs a cold or frozen freezable liquid pack placed on each side of the wine-filled bag, while another embodiment provides freezable, liquid-filled side, top, and rear panels. Thus, the user freeze the liquid packs or liquid-filled side, top, and rear panels prior to using the apparatus, and there is no provisiona for adjusting the temperature.

Mullen, U.S. Pat. No. 7,076,966 discloses a refrigerated liquid dispensing system includes a cabinet having a refrigerated compartment. At least one liquid container such as a water bottle is mounted in a receptacle in the compartment. A valve is mounted to the neck of the bottle for controlling the flow of liquid from the bottle. In one practice of the invention the valve is actuated by a spring plunger mounted to the door of the compartment so that the valve can be actuated without opening the door to dispense water from a valve stem into a cup in a cup holder area below the compartment. In a further practice of the invention the valve is actuated by opening the door and acting directly on the valve. When the door opens a valve extension automatically slides outwardly so that a dispensing opening in the valve extension is disposed against a cup in the cup holder area.

Williamson et al, U.S. Pat. No. 6,010,043 discloses a self-contained portable non-electric beverage dispensing system which utilizes ice as the cooling medium, and includes a housing having an interior space. A first cooling well for containing ice is defined in the interior space of the housing for pre-cooling of a beverage within a beverage container, and a second cooling well for receiving ice is defined in the interior space of the housing for cooling the beverage after it leaves the beverage container. A tank mounting structure is disposed within the interior space of the housing for holding a propellant gas-supply tank, which is used to pressurize the beverage container. The two separate cooling wells enhance the cooling of the beverage that is being dispensed.

Bedard, U.S. Pat. No. 6,516,625 discloses a juice dispensing apparatus designed for dispensing packaged "not from concentrate" juice from a rectangular paperboard "bag-in-box" container, the apparatus having a compartment in which the paperboard box containing the bag is mounted, a thermoelectric device for cooling the compartment and a piezoelectric device for agitating the juice in the bag to maintain the juice in a suspension. The box has a cutout in its bottom wall such that the bag rests on the piezoelectric agitating member and juice is dispensed from the bottom of the bag through a spigot and flexible discharge tube threaded through an aperture and a plunger of an electric actuator pinches the tube between a stop surface to control flow of juice from the tube. Alternatively, a spigot in the form of a valve is provided that has a pair of ears which may be lifted upwardly to permit the dispensing of the juice. A thermoelectric device is mounted between an inner back wall and a dividing wall of the compartment and a cold heat sink associated with the thermoelectric device is mounted interiorly of the container receiving compartment and a hot heat sink is mounted in a channel between an exterior rear wall the dividing wall. A pair of lower fans are mounted in the lower portion of dividing wall and a pair of upper fans are mounted in an upper portion of the dividing wall. The lower fans take air from under the bottom portion of the dispensing apparatus and pass it upwardly past the hot heat sink to exit from vent apertures formed in a gable top end of the apparatus. This apparatus is not particularly thermally efficient because the cold heat sink is in direct contact with the paperboard material of the box surrounding the bag to protect the bag during shipping and storage also forms an insulated barrier surrounding the bag.

Shirley, U.S. Pat. No. 4,304,341 discloses a refrigerated dispensing unit comprising a cabinet which receives one or more rectangular cardboard boxes of "bag-in-box" containers of the type having a dispensing valve projecting outwardly therefrom for dispensing liquid from the container. The door enclosing the cabinet and container is pivotally mounted and has one or more apertures therein including a deformable gasket to receive and releasably engage the dispensing valve on the container when the door is closed. The refrigerating apparatus is only described as a "conventional refrigerating apparatus" contained in the lower portion of the cabinet, and the refrigerating apparatus is not shown or described in detail. This device is not particularly thermally efficient because the cardboard material of the box that protects the bag during shipping and storage forms an insulated barrier surrounding the bag. Also, it is well known in the art, that cold air sinks while hot air rises, because cold temperatures causes the air molecules to come closer together and this makes it more dense or heavier; thus, placing the refrigerating apparatus in the lower portion of the cabinet beneath the container is counter productive to efficient cooling.

Curcio, U.S. Pat. No. 3,572,054 discloses a picnic cooler box having insulated compartments for containing food, ice, and water and additionally having syrup containers with dispensing spigots for the syrup, as well as dispensing spigots for the melted ice of the ice container and the water container.

SUMMARY OF THE INVENTION

The present invention overcomes the aforementioned problems and is distinguished over the prior art in general, and these patents in particular by a thermoelectric wine bag cooler/dispenser apparatus powered by household current has a thermally insulated cabinet that sits on a countertop or other flat surface and has a thermoelectric cooling system. The cabinet has at least one thermally insulated compartment that receives a removable bag support housing containing a collapsible flexible wine-filled bag from a "bag-in-box" wine container and its dispensing valve. The bag support housing includes a spring biased plate to facilitate emptying of the contents of the bag. The temperature of each compartment is individually controlled by a digital temperature controller and a thermoelectric cooling assembly which includes a fan and a cold plate engaged on a thermally conductive heat transfer block at the top of each compartment which engages the bag support housing.

One of the features and advantages of the thermoelectric wine bag cooler/dispenser is that it will maintain the contents of a bag of wine contained in a respective compartment at constant temperature and allow different wines to be maintained at different temperatures.

Another feature and advantage of the thermoelectric wine bag cooler/dispenser is that it is compact and can be placed on a countertop for easy access when needed, and can be easily stored when not in use.

Another feature and advantage of the thermoelectric wine bag cooler/dispenser is that it can contain and maintain several bags of wine, including different wines, at a desirable temperature making it particularly useful for entertaining a number of people such as at parties, social events, ceremonies, and weddings.

Another feature and advantage of the thermoelectric wine bag cooler/dispenser is that it can be used in households, bars, restaurants, and wineries.

Another feature and advantage of the thermoelectric wine bag cooler/dispenser is that it can accommodate conventional collapsible prepackaged and vacuum-sealed plastic wine bags removed from "bag-in-box" containers and is thermally efficient and chills fast because it directly cools the filled bag and the cool air does not have to penetrate the fiberboard, cardboard or paperboard material of the box that protects the bag during shipping and storage which would otherwise form an insulated barrier surrounding the bag.

Another feature and advantage of the thermoelectric wine bag cooler/dispenser is that it can accommodate conventional collapsible prepackaged and vacuum-sealed plastic wine bags removed from "bag-in-box" containers and is thermally efficient and chills fast because it places a cooling module at the top of the compartment and filled bag thereby causing the air molecules at the top of the compartment to come closer together making the air more dense or heavier and takes advantage of the phenomenon of the cold air sinking while the warm air rises.

Another feature and advantage of the thermoelectric wine bag cooler/dispenser is that it can accommodate conventional collapsible prepackaged and vacuum-sealed plastic wine bags removed from "bag-in-box" containers and eliminates oxygen intrusion, cork taint, and spoilage, even after the wine has been opened.

A further feature and advantage of the thermoelectric wine bag cooler/dispenser is that it can accommodate conventional collapsible prepackaged and vacuum-sealed plastic wine bags removed from "bag-in-box" containers and preserves the wine for up to about four weeks compared with only a day or two for a bottle after it has been uncorked.

A still further feature and advantage of the thermoelectric wine bag cooler/dispenser is that it is simple in construction, inexpensive to manufacture, and rugged and reliable in operation Other features and advantages of the present invention will become apparent from time to time throughout the specification and claims as hereinafter related.

DESCRIPTION OF THE PREFERRED EMBODIMENTS

The following terms and definitions will be used through this written description. The term "pouch" or "bag", as used herein, refers to a collapsible flexible pouch or bag, formed of a plastic material, for containing a liquid beverage such as wine and having a spigot or valve at one side of a lower end thereof for dispensing the contents, and more particularly, to such a bag which is used in a "bag-in-box" beverage container. A "bag-in-box" beverage container, as used herein, refers to a fiberboard, cardboard or paperboard box, typically corrugated, in which the "pouch" or "bag" containing the beverage is held, and through which the spigot or valve extends. As used herein, the term "bag support housing" means an enclosure that covers, protects, and supports a collapsible flexible bag. Although the present invention as described herein is applicable to cooling or chilling liquid beverages collectively called "wine", it should be understood that it is applicable to cooling or chilling any liquid beverage. Although the present invention as described hereinafter applies to cooling or chilling, it utilizes a thermoelectric system which operates on the "Peltier effect", and it should be understood that the present invention may be used to both chill and to warm the contents of the bag, since the thermoelectric device becomes cold or warm by simply switching the polarity of the DC electrical power.

Figure 2:
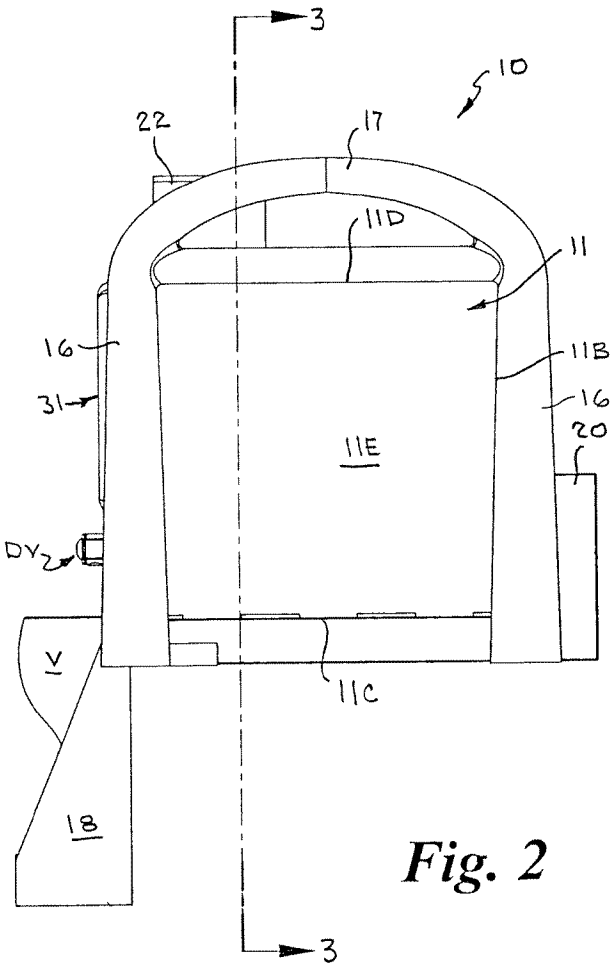
FIG. 2 is a side elevation of the thermoelectric wine bag cooler/dispenser.
Figure 1:
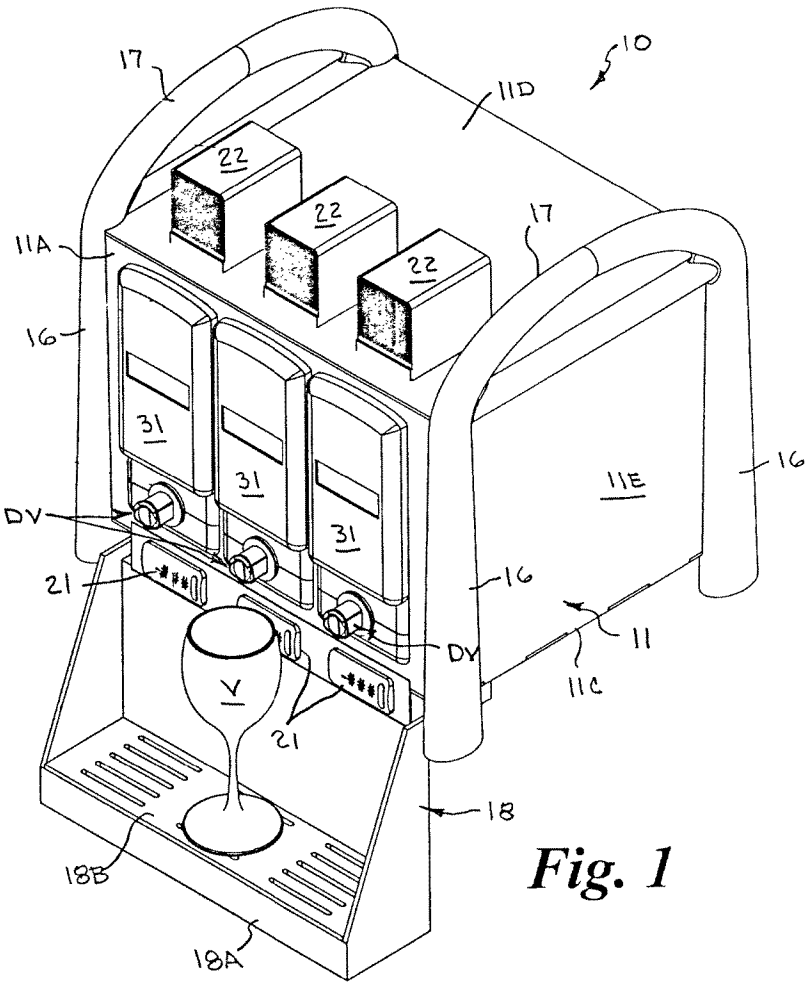
FIG. 1 is a perspective view of the thermoelectric wine bag cooler/dispenser apparatus in accordance with the present invention.
Figure 3:
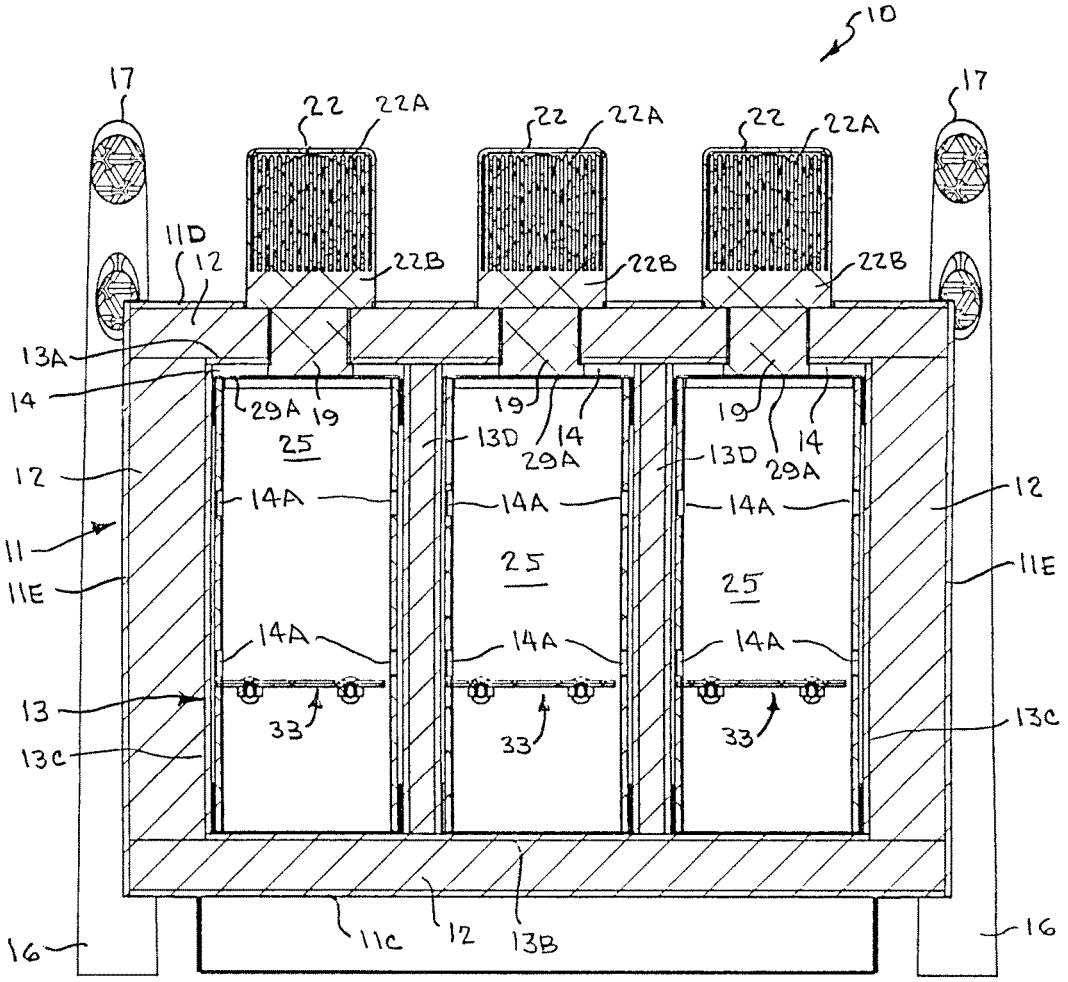
FIG. 3 is a cross sectional view of the thermoelectric wine bag cooler/dispenser, taken along line 3-3 of FIG. 2, shown at a larger scale.

Referring now to the drawings by numerals of reference, there is shown in FIGS. 1, 2 and 3, a preferred thermoelectric wine bag cooler/dispenser 10 having a thermally insulated cabinet 11 which sits on a countertop or other flat surface and is powered by household current. In the illustrated example, the thermally insulated cabinet 11 has three compartments, however, it should be understood, that the cabinet may have one compartment or a plurality of compartments (described hereinafter).

In the illustrated example, the thermally insulated cabinet 11 has a generally rectangular configuration with a front wall 11A, rear wall 11B, bottom wall 11C, top wall 11D, and laterally opposed outer side walls 11E. As best seen in FIG. 3, the inner facing surface of the walls are provided with a layer of thermally insulating material 12 and surround a central metal enclosure 13 which has a top wall 13A, bottom wall 13B, rear wall (not seen), laterally opposed side walls 13C, and an open front end. In the illustrated example, a pair of laterally spaced intermediate vertical walls 13D of double wall metal construction having a layer of thermally insulating material sandwiched between the double walls divide the central metal enclosure 13 into three generally rectangular open compartments 14 that slidably receive a respective bag support housing 25 (described hereinafter). Each of the laterally opposed side walls 13C of the compartments 14 may be provided with a pair of vertically spaced horizontal rails 14A for removably supporting the bag support housing 25.

Support legs 16 are secured adjacent to the four corners of the walls with their bottom ends terminating a short distance beneath the bottom wall 11C of the cabinet 11 and the top ends of the legs on laterally opposed sides curve upwardly and inwardly above the top wall 11D and are joined together to form a pair of handles 17 above the lateral side walls 11E.

A generally L-shaped drip tray 18 is mounted on the front of the cabinet 11 to extend transversely between the legs 16 on the front side of the cabinet and a distance below the bottom of the cabinet and has horizontal drip pan portion 18A with a grid 18B for supporting a drinking vessel V, such as a wine glass, and catching liquids that may drip or spill when filling the vessel.

A thermally conductive heat sink or heat transfer block 19 is mounted in the cabinet 11 and extends through the top wall 11D of the cabinet, the thermally insulating material 12 and the top wall 13A of the central metal enclosure 13, insulated therefrom, and has bottom end which engages a top member 29 of a respective bag support housing 25 (described hereinafter) when installed in the respective compartment.

A power supply module 20 is mounted on the back wall 11B of the cabinet 11 and temperature controllers 21 electrically connected with the power supply module are mounted on the front wall 11A beneath each compartment 14, respectively. A suitable 150 W single DC output power supply unit is commercially available from Marlin P. Jones & Assoc, Inc. of Lake Park, Fla. Such single output power supply units are available in models ranging in DC output voltage from 5V-30A to 36V-4.2A. The power supply module 20 operates on household current supplied by a power cord (conventional and well known in the art and therefore not shown).

In a preferred embodiment, the temperature controllers 21 are digital temperature controllers having an LED readout display panel. A suitable temperature controller for use is an Autonics Model TC3YT-B4R3, commercially available from Autonics of Vernon Hills, Ill.

Thermoelectric cooling assemblies 22 which include a fan 22A and a cold plate 22B are mounted on the top wall 11D of the cabinet 11, and operate on polarized current supplied by the power supply module 20 and controlled by the temperature controllers 21. The bottom surface of the cold plate 22B is engaged on the top surface of the thermally conductive heat transfer block 19 at the top of each respective compartment 14. A suitable thermoelectric cooling assembly for use is a SUPERCOOL™ Model DA-020-12-02, commercially available from Laird Technologies division of Laird PLC., of Minneapolis, Minn. The thermoelectric assembly 22 operating on the principle of the "Peltier effect" directly cools the cold plate 22B, and the thermally conductive heat transfer block 19 at the top of the cabinet dissipates heat. Heat absorbed by the heat transfer block 19 is pumped through the thermoelectric modules and then dissipated to the air.

The particular electrical wiring and circuitry is conventional and well known to those skilled in the art and, therefore, are not shown and described in detail.

Referring now additionally to FIGS. 4-8, the bag support housing 25 which contains the flexible collapsible bag B from the box of a "bag-in-box" container is shown in greater detail. The components of the bag support housing 25 are made of metal plate and when assembled, the bag support housing has a generally rectangular configuration. The components include: an elongate rectangular front plate 26 having a vertical slot 26A extending longitudinally from its top end terminating in a curved bottom 26B and generally rectangular vertically spaced tongue portions 26C along laterally opposed sides; an elongate rectangular rear plate 27; and laterally opposed side plates 28, each having a pair of elongate vertically spaced horizontal slots 28A, and a small hole 28B near their front bottom edge; a rectangular inverted box-like removable top member 29 having a top wall 29A and four relatively short side walls 29B; and a rectangular box-like bottom member 30 having a bottom wall 30A and four relatively short side walls 30B, the front wall of which has a curved semicircular recess 30C of approximately the same size as the curved bottom 26B of the slot 26A of the front plate 26. A door assembly 31 is mounted on the front end of the bag support housing 25.

Figure 4:
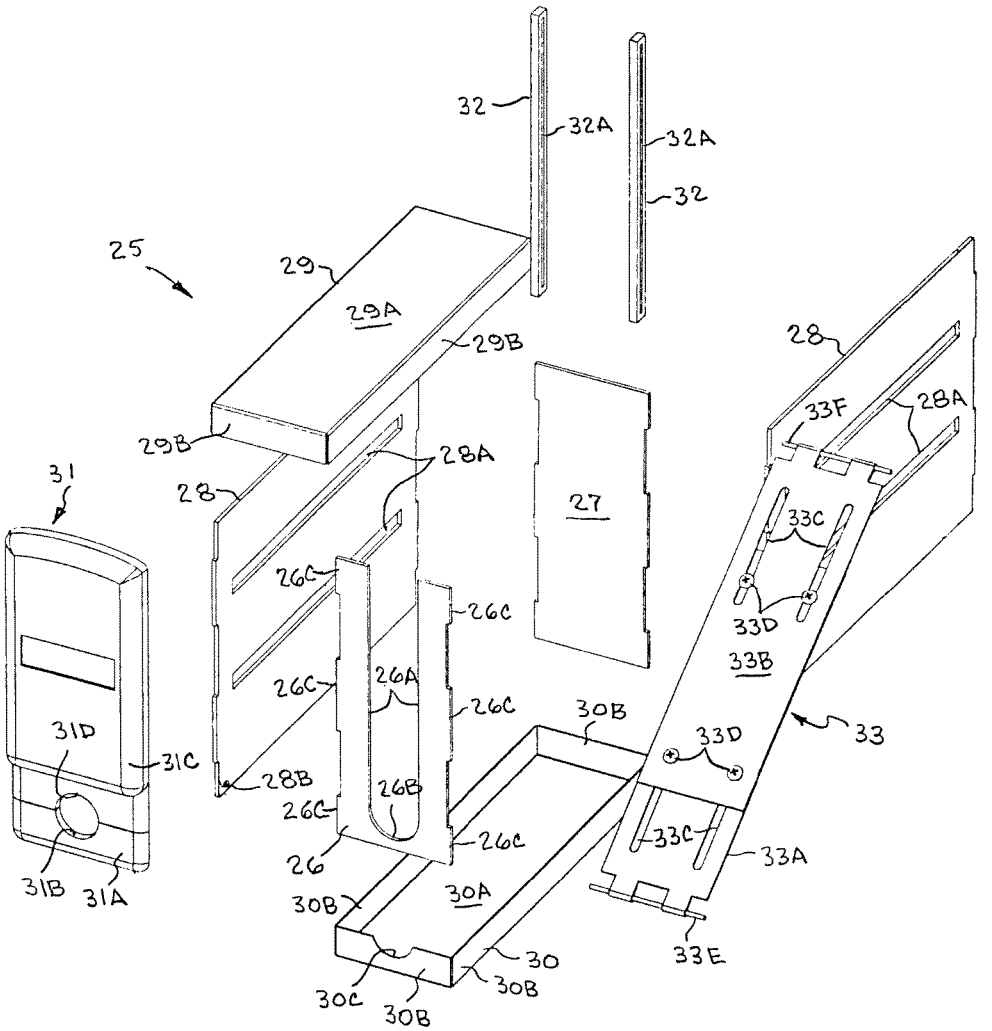
FIG. 4 is an exploded perspective view of the components of the bag support housing of the thermoelectric wine bag cooler/dispenser.
Figure 5:
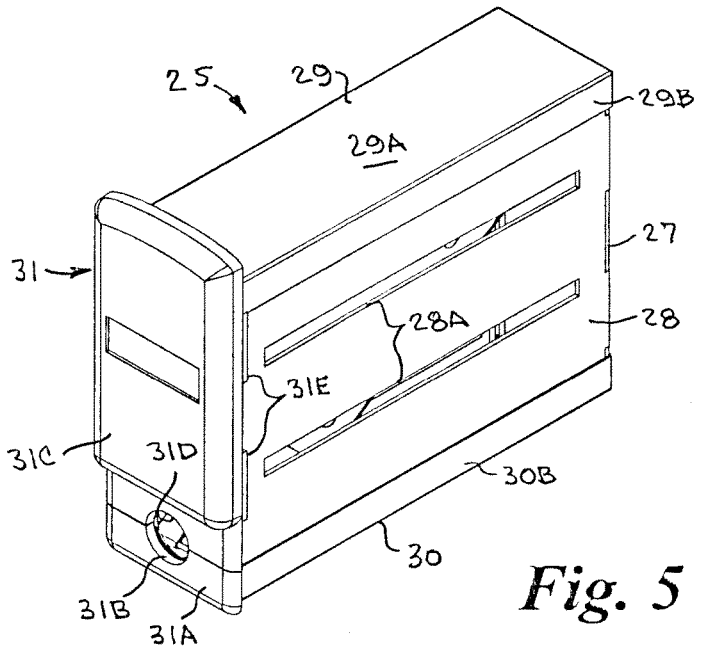
FIG. 5 is a perspective view of the bag support housing of the thermoelectric wine bag cooler/dispenser, shown in the assembled condition without a bag placed inside thereof.
Figure 6:
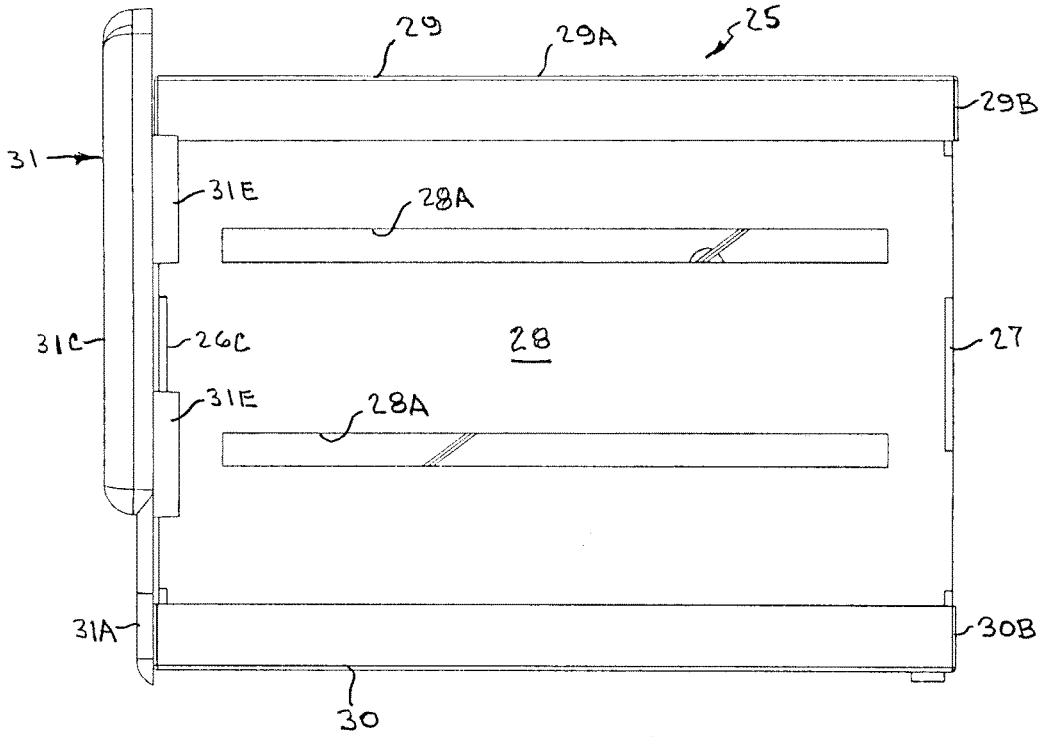
FIG. 6 is a side elevation of the assembled bag support housing of the thermoelectric wine bag cooler/dispenser, showing the sliding door arrangement.
Figure 7:
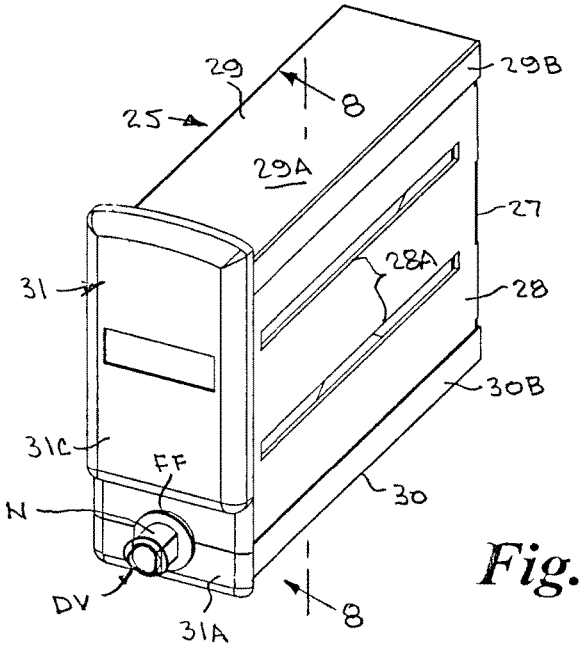
FIG. 7 is a perspective view of the bag support housing of the thermoelectric wine bag cooler/dispenser containing a flexible collapsible bag from a "bag-in-box" container, showing the dispensing valve of the bag extending from the front thereof.

As best seen in FIGS. 4, 5 and 6, when the front plate 26, rear plate 27, and side plates 28, are assembled together as described below, the generally rectangular vertically spaced tongue portions 26C along the laterally opposed sides of the front plate 26 protrude outwardly a short distance from the laterally opposed side plates 28. The door assembly 31 has a generally rectangular bottom member 31A which has a curved semicircular recess 31B at its top end of approximately the same size as the curved bottom 26B of the slot 26A of the front plate 26, and a generally rectangular top member 31C having a complementary curved semicircular recess 31D at its bottom end. The bottom member 31A of the door assembly 31 is affixed or mounted on the lower portion of the front plate 26 by conventional means such as by adhesives, fasteners, or snap fitting. The top member 31C of the door assembly 31 has a pair of generally rectangular vertically spaced tabs 31E along laterally opposed sides which have grooves on their inner facing sides that are slidably received on the tongue portions 26C along the laterally opposed sides of the front plate 26. Thus, the top member 31C of the door assembly 31 can slide vertically relative to the bottom member 31A.

Figure 8:
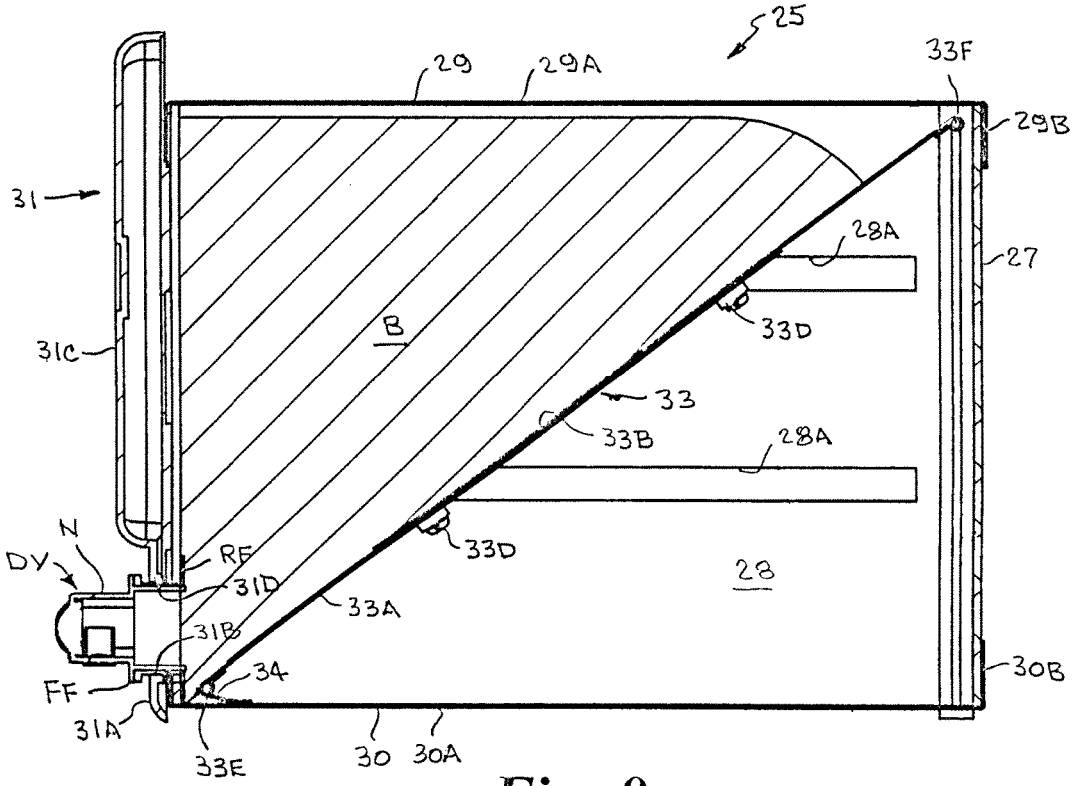
FIG. 8 is a cross sectional view of the bag support housing of the thermoelectric wine bag cooler/dispenser, taken along line 8-8 of FIG. 7, showing the flexible collapsible bag supported on a spring biased plate in a partially emptied condition.

A pair of elongate narrow rectangular guide members 32 each having a longitudinal vertical slot 32A are secured, one adjacent to the rear edge of each side plate 28, respectively. A spring biased bag support plate assembly 33 is pivotally mounted between the side plates 28. The bag support plate assembly 33 is made of two overlapped slidably connected plates 33A and 33B, each having pair of laterally spaced slots 33C which receive fasteners 33D that allow relative sliding movement of the plates and each having a transverse pin 33E and 33F at their outer end. As best seen in FIG. 8, a spring 34, such as a torsion spring, surrounds the pin 33E at the front end of the bag support plate assembly 33.

The front plate 26, rear plate 27, and side plates 28, are assembled together and the top and bottom ends of the assembly are enclosed by the box-like top and bottom members 29 and 30. The box-like top member 29 may be removed from the top end of the assembly for gaining access to the interior. When assembled, the outer ends of the transverse pin 33F at the rear end of the bag support plate assembly 33 are received and slidably engaged in the longitudinal slots 32A of the laterally opposed guide members 32, and the outer ends of the transverse pin 33E at the front end of the bag support plate assembly are received in the small holes 28B near the front bottom edge of the laterally opposed side plates 28. The spring 34 which surrounds the pin 33E at the front end of the bag support plate assembly 33 has one end engaged on the bottom wall 30A of the bottom member 30 and its other end engaged on the underside of the front most plate 33A.

Thus, the bag support plate assembly 33 is pivotally connected at the front end and the pin 33F at the rear end thereof rides in the vertical slots 32A of the guide members 32 at the back end, such that the bag support plate is spring biased to rise up at the back end as the bag B supported thereon becomes empty. This facilitates dispensing of the bag contents as it becomes empty. Typically, with a conventional "bag-in-box" beverage container, the contents pours slowly as it becomes empty because it is under a vacuum and there is not a lot of weight left to push the liquid beverage out.

Figure 9:
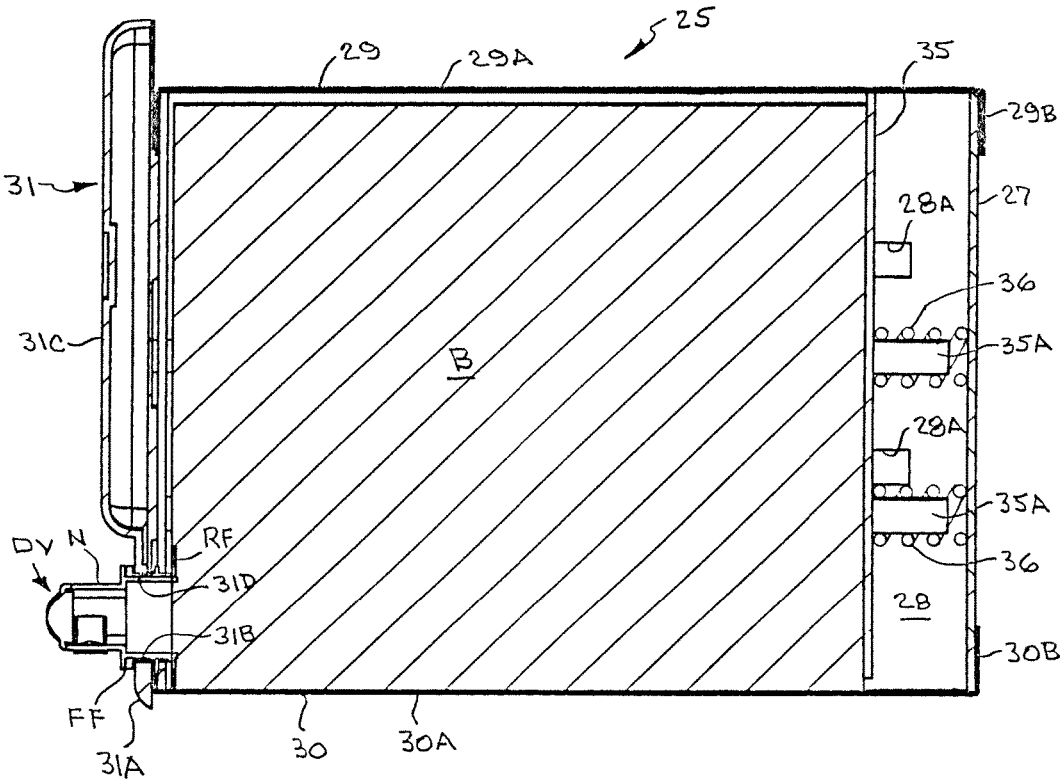
FIG. 9 is a cross sectional view of the bag support housing of the thermoelectric wine bag cooler/dispenser, similar to FIG. 8, showing an alternate spring biased plate for facilitating emptying of the bag.

FIG. 9 shows, somewhat schematically, an alternate spring biased plate arrangement for facilitating emptying of the bag B. The components which are the same as described above are assigned the same numerals of reference, but will not be described again in detail to avoid repetition. In this modification, the bag support plate assembly is replaced by a generally rectangular vertical plate 35 which is slidably mounted between the laterally opposed side plates 28, and the rear plate 27. A pair of guide pins 35A extend a short distance from the rear surface of the vertical plate 35, each surrounded by a compression spring 36 having one end engaged on the rear surface of the vertical plate and its opposed end engaged on the rear plate 27. The springs 36 push the vertical plate 35 forward as the bag B becomes empty to facilitate dispensing of the contents.

The conventional collapsible flexible bag containing the wine or other beverage has a dispensing tap, spigot, or valve DV at one side of a lower end thereof for dispensing the contents. The dispensing valve DV typically has neck portion N with a rear flange RF which is sealed to the bag B, an intermediate flange spaced forwardly therefrom, and a radial front flange FF spaced forwardly from the intermediate flange or rear flange. When the bag B containing wine or other beverage is removed from its box container, its dispensing valve DV remains on the bag.

It should be understood from the foregoing that each bag support housing 25 is slidably received within, and removable from a respective compartment 14 of the central enclosure 13 of the cabinet 11, and the top member 29 of the bag support housing is engaged on the bottom end of the thermally conductive heat block 19 when received in the compartment (FIG. 3). When the bag support housing 25 is slid into the compartment 14, the horizontal rails 14A on the laterally opposed side walls of the compartment are received in the horizontal slots 28A in the side plates 28 of the bag support housing to slidably support the bag support housing. When the bag support housing 25 is removed from the compartment 14, the top member 29 is removed to place a filled bag B into the interior of the bag support housing to be supported therein on the bag support plate assembly 33 or in front of the alternate vertical plate 35, or to allow an empty bag to be removed therefrom.

In utilizing the present cooler/dispenser 10, the bag B containing wine or other beverage including its dispensing valve DV is removed from its box container. The bag support housing 25 is removed from the compartment 14 of the cabinet 11, the top portion 31C of the door assembly 31 is raised, and the top member 29 is removed from the bag support housing, the neck portion N of the valve DV is placed in the slot 26A of the front plate 26 with its intermediate flange or rear flange RF on the inner facing side and its radial front flange FF on the outer facing side. The filled bag B is lowered into the interior of the bag support housing 25 such that the neck portion N of the valve DV rests in the semicircular recess 31B in the bottom member 31A of the door assembly 31. The top member 29 of the bag support housing 25 is placed back on the top end of the bag support housing 25, and the top member 31C of the door assembly is then lowered down such that its complementary semicircular recess 31D captures the neck portion N of the valve DV with its radial front flange RF residing on the exterior of the door assembly 31. The bag support housing 25 now containing the bag B is then placed back into a respective compartment 14 of the central enclosure 13 of the cabinet 11, such that the top member 29 of the bag support housing is engaged on the bottom end of the thermally conductive heat block 19 at the top of the compartment.

The temperature controller 21 can be set to chill and maintain the wine or other beverage at a desired constant temperature, and in the case of plural compartments, each temperature controller can be set to chill and maintain different wines or other beverages at different temperatures.

It should be understood, that the present cabinet and bag holding assemblies may be sized to accommodate three-liter to five-liter wine pouches or bags of wine or other beverages, or even larger for commercial applications. Although the present invention applies to cooling or chilling, it utilizes a thermoelectric system which operates on the "Peltier effect", and it should be understood that the present invention may be used to both a chill and warm the contents of the bag, since the thermoelectric device becomes cold or warm by simply switching the polarity of the DC electrical power.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A Peltier thermoelectric cooling and dispensing apparatus for cooling and dispensing wine contained in a plurality of collapsible flexible bags each having a dispensing valve at a lower portion of a front end thereof, comprising:

a generally rectangular cabinet having a thermally insulated front wall, rear wall, top wall, bottom wall, and laterally opposed side walls, and a plurality of generally rectangular interior compartments therein disposed side-by-side, each of said interior compartments defined by a generally rectangular central enclosure having a top wall, bottom wall, rear wall, an open front end, and laterally spaced thermally insulated vertical walls;

a plurality of thermally conductive bag support housings, each removably received in a respective said interior compartment for removably receiving and supporting a respective said collapsible flexible bag, each having an elongate rectangular front end plate with a vertical slot extending longitudinally from a top end terminating in a curved bottom for slidably receiving and supporting a tubular neck portion of the dispensing valve at the lower portion of the collapsible flexible bag in an outwardly extending position, an elongate rectangular rear plate, laterally opposed side plates, a rectangular removable top member having a top end wall, a rectangular bottom member having a bottom wall, and a rectangular generally vertical spring biased bag support plate upon which a back portion of the collapsible flexible bag received in said housing is engaged, said spring biased bag support plate slidably mounted between said laterally opposed side plates and said rectangular rear plate, and having at least one compression spring engaged between said bag support housing rear plate and said generally vertical bag support plate to bias said bag support plate forwardly as the bag becomes emptied and facilitate dispensing and complete emptying of the bag contents through the dispensing valve at the lower portion of the collapsible flexible bag;

a sliding door assembly mounted on each said bag support housing front end plate, each having a generally rectangular bottom door member mounted on said front plate with a downwardly curved semicircular recess at a top end aligned with said curved bottom of said slot in said front end plate to partially encircle a lower portion of the outwardly extending tubular neck portion of the bag dispensing valve, and a generally rectangular top door member slidably mounted on said front end plate having a complementary upwardly curved semicircular recess at a bottom end to partially encircle an upper portion of the outwardly extending neck portion of the bag dispensing valve and releasably retain the dispensing valve in a manually operable position;

a plurality of thermally conductive heat transfer members each mounted at a top end of a respective said interior compartment and having one end surface disposed to engage said thermally conductive top end wall surface of a respective said bag support housing received in said respective interior compartment;

a plurality of thermoelectric cooling assemblies that operate on the principle of the Peltier effect utilizing polarized DC current, each including a fan and a cold plate, said cold plate engaged on an opposed second end surface of a respective said thermally conductive heat transfer member wherein heat absorbed by said heat transfer member is dissipated to the exterior of said cabinet;

a power supply member mounted on said cabinet electrically coupled with each of said thermoelectric cooling assemblies and operated by household AC current to provide a polarized DC output current thereto; and a plurality of adjustable temperature controllers with LED readout display panels, each mounted on said cabinet adjacent to a respective said interior compartment and electrically connected with said power supply member and with a respective said thermoelectric cooling assembly for controlling the operation of said respective thermoelectric cooling assembly responsive to a selected temperature setting so as to chill and maintain a respective wine-filled collapsible flexible bag at a selected constant temperature, and maintain different wines at different temperatures.

2. The Peltier thermoelectric cooling and dispensing apparatus according to claim 1, further comprising:

a generally L-shaped drip tray having a vertical portion mounted on said cabinet front wall beneath said sliding door assemblies and a horizontal drip pan portion at a bottom end thereof covered by a grid for supporting a drinking vessel to be filled.

3. The Peltier thermoelectric cooling and dispensing apparatus according to claim 1, further comprising:

support legs on said cabinet having bottom ends terminating a distance beneath said cabinet bottom wall for supporting said cabinet bottom wall above a flat support surface; and a pair of handles extending above said cabinet top wall for lifting and transporting said cabinet.

4. The Peltier thermoelectric cooling and dispensing apparatus according to claim 1, wherein each said generally vertical bag support plate has a first and a second guide pin extending a short distance from a rear surface thereof, and said at least one compression spring comprises a first and a second compression spring, each surrounding a respective said guide pin and having one end engaged on said rear surface of said generally vertical bag support plate and its opposed end engaged on said rear plate of a respective said bag support housing.

5. A Peltier thermoelectric cooling and dispensing apparatus for cooling and dispensing wine contained in a collapsible flexible bag having a dispensing valve at a lower portion of a front end thereof, comprising:

a generally rectangular cabinet having a thermally insulated front wall, rear wall, top wall, bottom wall, and laterally opposed side walls, defining a generally rectangular interior compartment;

a thermally conductive bag support housing removably received in said interior compartment for removably receiving and supporting the collapsible flexible bag, an elongate rectangular front end plate with a vertical slot extending longitudinally from a top end terminating in a curved bottom for slidably receiving and supporting a tubular neck portion of the dispensing valve at the lower portion of the collapsible flexible bag in an outwardly extending position, an elongate rectangular rear plate, laterally opposed side plates, a rectangular removable top member having a top end wall, a rectangular generally vertical spring biased bag support plate upon which a back portion of the collapsible flexible bag received in said housing is engaged, said spring biased bag support plate slidably mounted between said laterally opposed side plates and said rectangular rear plate, and having at least one compression spring engaged between said bag support housing rear plate and said generally vertical bag support plate to bias said bag support plate forwardly as the bag becomes emptied and facilitate dispensing and complete emptying of the bag contents through the dispensing valve at the lower portion of the collapsible flexible bag;

a sliding door assembly mounted on said bag support housing front end plate including a generally rectangular bottom door member mounted on said front plate with a downwardly curved semicircular recess at a top end aligned with said curved bottom of said slot in said front end plate to partially encircle a lower portion of the outwardly extending tubular neck portion of the bag dispensing valve, and a generally rectangular top door member slidably mounted on said front end plate having a complementary upwardly curved semicircular recess at a bottom end to partially encircle an upper portion of the outwardly extending neck portion of the bag dispensing valve and releasably retain the dispensing valve in a manually operable position;

a thermally conductive heat transfer member mounted at a top end of said interior compartment and having one end surface disposed to engage said thermally conductive top end wall surface of said bag support housing received in said interior compartment;

a thermoelectric cooling assembly that operates on the principle of the Peltier effect utilizing polarized DC current, including a fan and a cold plate, said cold plate engaged on an opposed second end surface of said thermally conductive heat transfer member wherein heat absorbed by said heat transfer member is dissipated to the exterior of said cabinet;

a power supply member mounted on said cabinet electrically coupled with said thermoelectric cooling assembly and operated by household AC current to provide a polarized DC output current thereto; and an adjustable temperature controller with a LED readout display panel mounted on said cabinet adjacent to said interior compartment and electrically connected with said power supply member and with said thermoelectric cooling assembly for controlling the operation of said thermoelectric cooling assembly responsive to a selected temperature setting so as to chill and maintain the wine-filled collapsible flexible bag at a selected constant temperature.

6. The Peltier thermoelectric cooling and dispensing apparatus according to claim 5, further comprising:

a generally L-shaped drip tray having a vertical portion mounted on said cabinet front wall beneath said sliding door assembly and a horizontal drip pan portion at a bottom end thereof covered by a grid for supporting a drinking vessel to be filled.

7. The Peltier thermoelectric cooling and dispensing apparatus according to claim 5, further comprising:

support legs on said cabinet having bottom ends terminating a distance beneath said cabinet bottom wall for supporting said cabinet bottom wall above a flat support surface; and a pair of handles extending above said cabinet top wall for lifting and transporting said cabinet.

8. The Peltier thermoelectric cooling and dispensing apparatus according to claim 5, wherein said generally vertical bag support plate has a first and a second guide pin extending a short distance from a rear surface thereof, and said at least one compression spring comprises a first and a second compression spring, each surrounding a respective said guide pin and having one end engaged on said rear surface of said generally vertical bag support plate and its opposed end engaged on said rear plate of a respective said bag support housing.

* * * * *